US011490701B2

(12) United States Patent
Dona

(10) Patent No.: US 11,490,701 B2
(45) Date of Patent: Nov. 8, 2022

(54) GLASSES CASE HAVING A REDUCIBLE SIZE

(71) Applicant: SAFILO SOCIETÀ AZIONARIA FABBRICA ITALIANA LAVORAZIONE OCCHIALI S.P.A., Padua (IT)

(72) Inventor: Cristian Dona, Padua (IT)

(73) Assignee: SAFILO SOCIETA AZIONARIA FABBRICA ITALIANA LAVORAZIONE OCCHIALI S.P.A., Padua (IT)

( * ) Notice: Subject to any disclaimer, the term of this patent is extended or adjusted under 35 U.S.C. 154(b) by 204 days.

(21) Appl. No.: 16/635,627

(22) PCT Filed: Jul. 26, 2018

(86) PCT No.: PCT/IB2018/055596
§ 371 (c)(1),
(2) Date: Jan. 31, 2020

(87) PCT Pub. No.: WO2019/025915
PCT Pub. Date: Feb. 7, 2019

(65) Prior Publication Data

US 2021/0120928 A1 Apr. 29, 2021

(30) Foreign Application Priority Data

Aug. 3, 2017 (IT) ..... 102017000090077

(51) Int. Cl.
*A45C 11/04* (2006.01)
*A45C 7/00* (2006.01)
(Continued)

(52) U.S. Cl.
CPC ..... *A45C 11/04* (2013.01); *A45C 7/0077* (2013.01); *A45C 13/04* (2013.01); *A45C 13/103* (2013.01)

(58) Field of Classification Search
CPC ..... A45C 11/04; A45C 7/0077; A45C 13/04; A45C 13/103; A45C 13/1046; A45C 2013/1015
(Continued)

(56) References Cited

U.S. PATENT DOCUMENTS 1,691,904 A * 11/1928 Gamble ..... A45C 11/02 206/8
2,301,182 A * 11/1942 Kaser ..... A45C 11/04 220/4.22

(Continued)

*Primary Examiner* — Ernesto A Grano
(74) *Attorney, Agent, or Firm* — Volpe Koenig

(57) ABSTRACT

A glasses case having a reducible size is described, having an inner frame including a filiform element made of resiliently flexible material. The element has a closed profile and is folded to assume a first, saddle-shaped configuration in which two portions of the element are formed that extend laterally from opposite sides with respect to a top zone of the element, and a case body, which holds the frame in the operative configuration, the body is connected to the frame along its profile and extends to delimit the inner volume of the case. The case has a second, non-operative configuration having a smaller size by a first relative torsional fold of the frame portions, thus forming a substantially eight-shaped configuration, followed by a second fold that brings the frame portions together such that they lie one on top of the other until a flattened shape of the case is obtained.

10 Claims, 8 Drawing Sheets

(51) Int. Cl.
*A45C 13/04* (2006.01)
*A45C 13/10* (2006.01)

(58) Field of Classification Search
USPC ..... 206/5
See application file for complete search history.

(56) References Cited

U.S. PATENT DOCUMENTS 2,739,698 A * 3/1956 Baratelli ..... A45C 11/04 206/5
3,496,574 A * 2/1970 Liverant ..... A42B 1/201 2/175.4
4,096,590 A * 6/1978 Keshock ..... A42B 1/201 2/175.2
4,863,013 A * 9/1989 Eastman ..... A45C 11/04 206/5
5,645,096 A * 7/1997 Hazinski ..... E04H 15/40 135/115
5,800,067 A * 9/1998 Easter ..... A45C 7/0063 135/126
5,878,443 A * 3/1999 Seiler ..... A45C 11/04 2/426
6,164,452 A * 12/2000 Ellis ..... A45C 11/04 206/5
6,206,217 B1 * 3/2001 Chiang ..... A45C 7/005 206/37
6,216,277 B1 * 4/2001 Cheng ..... A42B 1/201 2/171.03
6,581,760 B1 * 6/2003 Robertson ..... A45C 11/04 206/320
6,672,323 B2 * 1/2004 Gupta ..... E04H 15/40 135/126
6,783,016 B2 * 8/2004 Wang ..... A42B 1/006 220/9.2
6,851,136 B2 * 2/2005 Brereton ..... A47D 9/005 135/126
7,150,499 B2 * 12/2006 McGregor ..... B60N 2/2842 297/184.13
7,523,719 B2 * 4/2009 Miller ..... A01K 1/0254 119/496
7,699,186 B2 * 4/2010 Zheng ..... E04H 15/405 220/565
D622,466 S * 8/2010 Sabounjian ..... D32/37
7,988,681 B2 * 8/2011 McGarity ..... B65F 1/0006 604/317
D646,741 S * 10/2011 Akaka ..... D21/837
8,590,698 B1 * 11/2013 Osborne ..... A45F 5/021 206/5
8,789,689 B1 * 7/2014 Wong ..... A45C 11/04 206/6
D802,226 S * 11/2017 Caputo ..... D30/108
9,949,520 B2 * 4/2018 Terada ..... A42B 1/201
D872,208 S * 1/2020 Zhu ..... D21/834
D916,223 S * 4/2021 Chen ..... D21/834
D935,773 S * 11/2021 Fuller ..... D3/303
2002/0043472 A1 * 4/2002 Guyot ..... A45C 11/04 206/5
2004/0112908 A1 * 6/2004 Tillmann ..... A47D 13/02 220/666
2012/0292313 A1 * 11/2012 Erlich ..... A45C 7/0077 220/9.2
2014/0254959 A1 * 9/2014 Peck ..... A45C 7/0077 383/107

* cited by examiner

GLASSES CASE HAVING A REDUCIBLE SIZE

TECHNICAL FIELD

This invention relates to a glasses case having a reducible size.

In the prior art, glasses cases have been traditionally designed with rather rigid configurations, whose size may not be particularly easy to use.

TECHNOLOGICAL BACKGROUND

Over time, the evolution of glasses cases has also led to the design and distribution of cases characterised by significant dimensions also in "non-operative" configurations, that is, with shafts, which are folded in on the case when it is closed. It is typical for glasses with a wraparound style, characterised by an accentuated curve (that is, with a reduced radius of curvature) on the front case, which necessarily maintain a significant transversal dimension even in the closed configuration with the shafts folded.

For these types of glasses, there is accordingly the need to have boxes with an appropriate capacity, which is therefore reflected in considerable sizes of similar cases. Cases with these dimensions thus do not prove to be particularly comfortable to bring along or to store, for example, in the pocket of a piece of clothing.

DESCRIPTION OF THE INVENTION

The primary object of the invention is to provide a glasses case structurally and functionally designed to exceed the limits highlighted referring to the cited prior art.

This and other purposes to be mentioned later are achieved by this invention by means of a case designed according to the attached claims.

BRIEF DESCRIPTION OF THE DRAWINGS

The characteristics and advantages of the improved invention will result from the following detailed description with its preferred embodiment illustrated, as an indication but not a limitation, referring to the designed units wherein.

PREFERRED EMBODIMENTS OF THE INVENTION

With reference to the figures cited, 1 substantially refers to a glasses case designed according to the invention.

Figure 1:
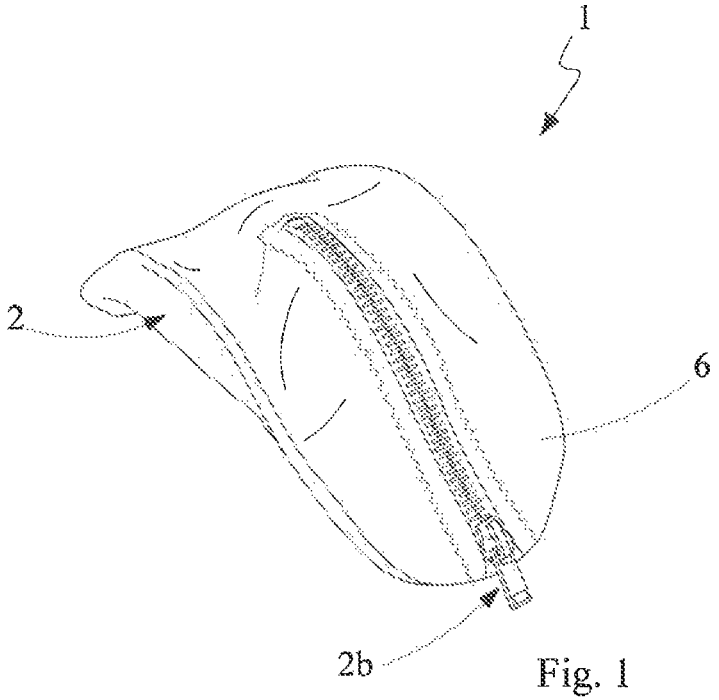
FIG. 1 is a perspective view of a case designed according to this invention.
Figure 2:
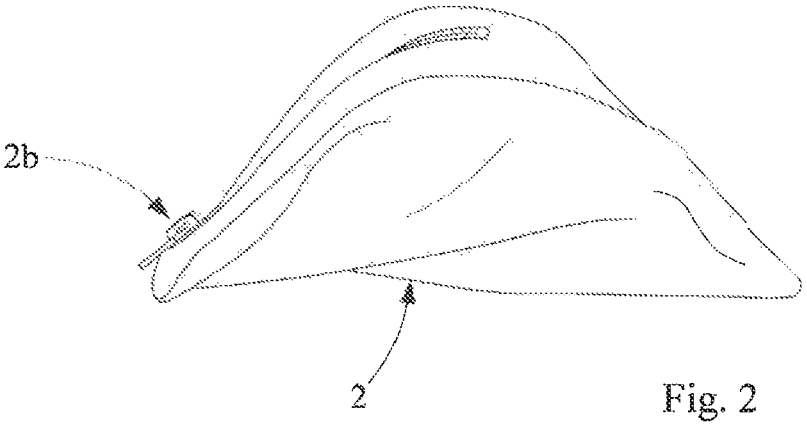
FIG. 2 is a further perspective view of the case from FIG. 1.
Figure 3:
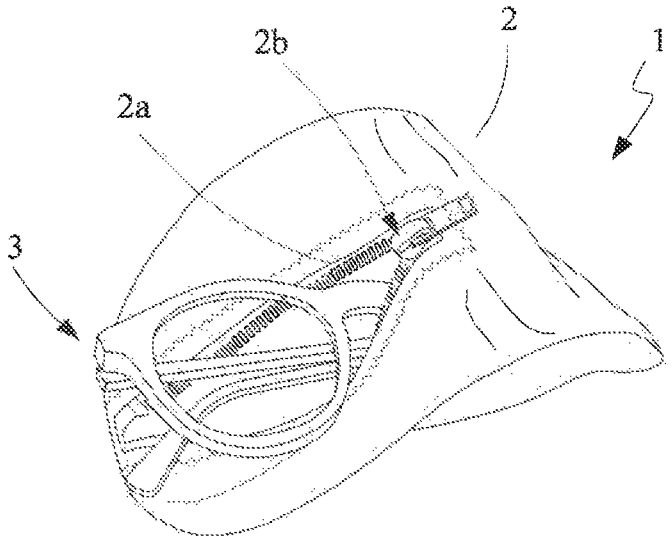
FIG. 3 is a perspective view of the case from the preceding figures depicted with a pair of spectacles partially housed within it.

The case 1 comprises a case body 2, conveniently designed with a flexible (or foldable) material with a reduced thickness, delimiting the inner case volume, which is to house a glasses frame, generically illustrated in FIG. 3 and distinguished by reference 3.

To insert/remove the glasses from the case, the body 2 is provided with an opening 2*a*, which can be resealed, for example, with a zipper mechanism 2*b* (also known as a "zip" closure).

Said case is prepared to house within the body 2 an inner frame, globally indicated by 4, designed with a filiform element 5 made of resiliently flexible material, connected to the body 2 to take on a first, prefixed, operative configuration, the maximum size of the case, in which the glasses 3 can be housed inside the same, then to assume a second, non-operative configuration, having a reduced size, when the glasses are not stored in the case, which will be clear from the following description.

The filiform element 5 of the frame 4 is designed with a material characterised by resilient flexibility. Said material can be made of a metallic material, such as harmonic steel, or a plastic material, such as a polyamide-based material (specifically indicated commercially under the name "NYLON") or another type of polymer material.

In the preferred embodiment created, illustrated below, the material of the filiform element 5 is meant to be a metallic material.

Said filiform element 5 presents a closed profile and is folded so as to assume said first, substantially saddle-shaped configuration.

To obtain such a saddle-shaped configuration, it is preferably expected to start with a straight metal wire, folded into a ring, with the respective free ends interconnected. An example of junction can provide that the ends of the wire are locked inside a metal sleeve, by means of a plastic deformation of the same (for example, by means of crushing).

Figure 4:
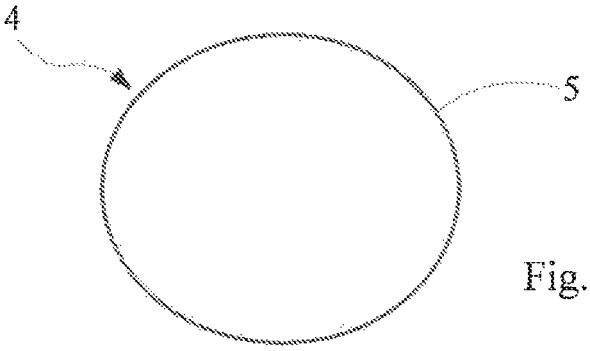
FIGS. 4, 5 and 6 are views of one element of the case from the preceding figures, in a sequence of folding phases with which a first prefixed configuration of the element is achieved.

This first deformation of the filiform element 5, shown in FIG. 4, made in the plane on which the wire lies, entails the onset of the first level of elastic tension in the wire itself.

Figure 5:
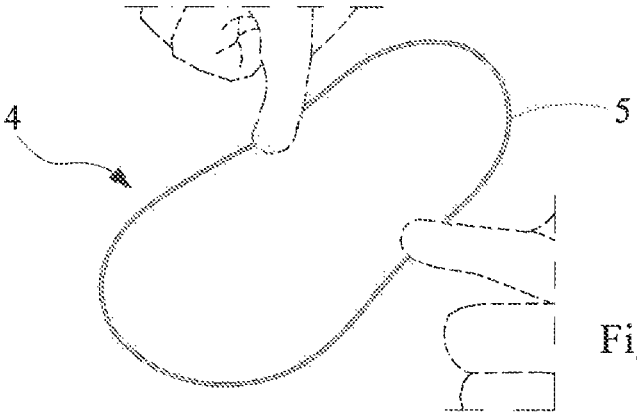
Figure 6:
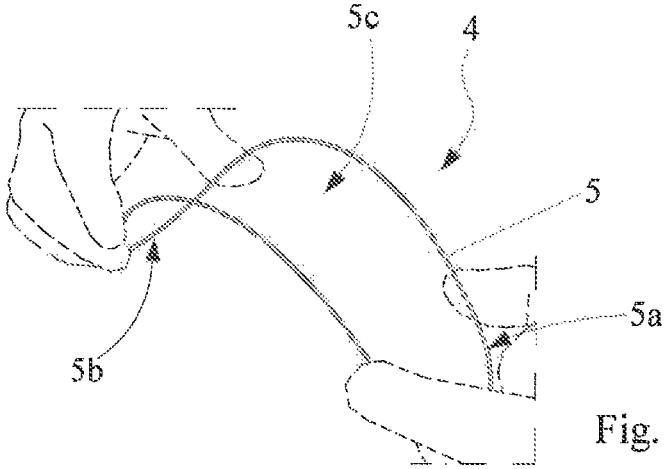

From this configuration, the ring-shaped wire with a closed profile is further folded, by means of a second deformation, bringing together two diametrically opposed stretches of wire, as shown in FIG. 5, achieving a substantially oval shape, in which a corresponding increase in elastic strength is introduced to the wire. From this final configuration by means of a third configuration, the oval is folded into an arcuate conformation on a folding plane perpendicular to the original plane on which the ring lies, achieving the saddle-shaped (arcuate oval) configuration shown in FIG. 6. With this fold, a final increase in elastic tension is introduced to the wire.

In the final saddle-shaped configuration, two opposite arcuate portions 5*a*, 5*b* are identified in the filiform element 5, which extend laterally from opposite sides with respect to a top area 5*c* of the saddle.

The frame 4, which maintains the saddle shape only if held in such position, in contrast to the elastic recall strength introduced to the folds, is housed and held within the case body 2, which presents an outer edge 6 with a corresponding saddle shape. In other words, the case body 2 connects the saddle-shaped frame 4, allowing it to be deformed in certain directions and to be deformed in a limited way or not at all in the remaining directions.

Figure 6A:
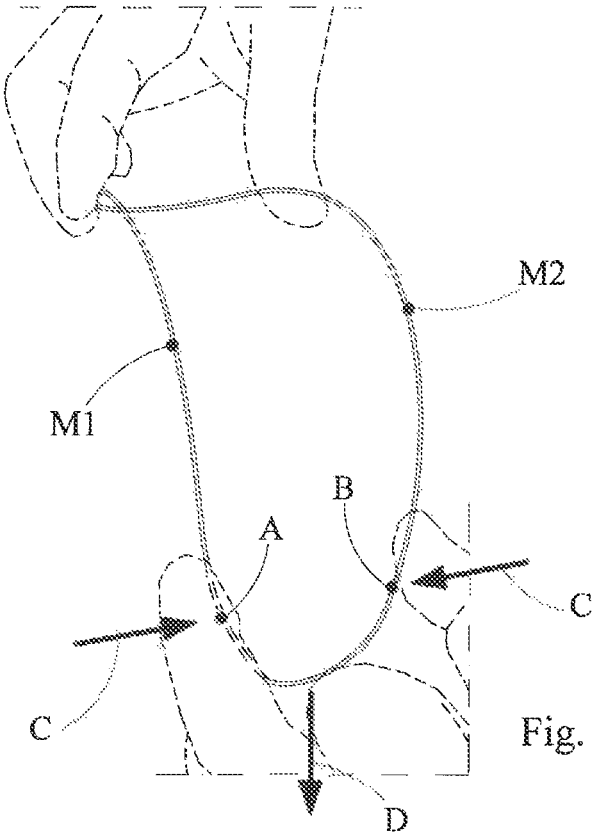
FIG. 6A is a further perspective view corresponding to that of FIG. 6, FIGS. 7, 8, 9 and 10 are views of one element from FIG. 6, in a sequence of folding phases with which a second configuration of the element is achieved.
Figure 7:
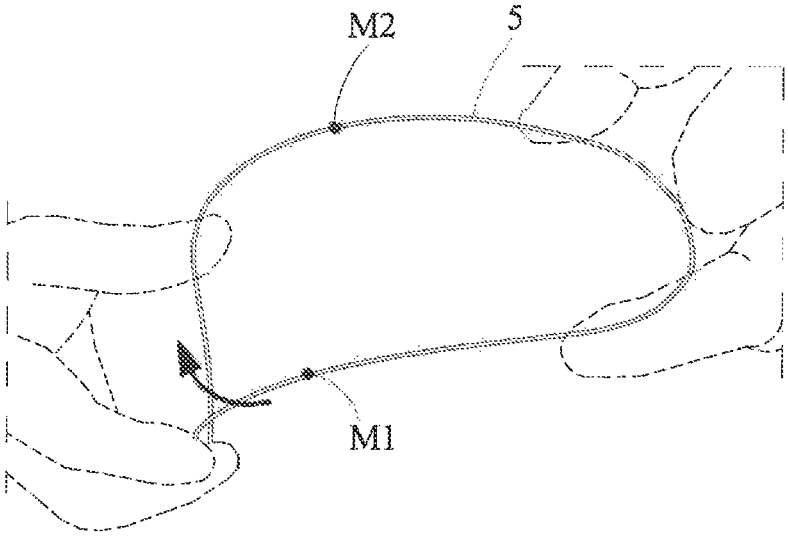

When the frame is placed inside the case, if an attempt is made to compress the filiform element (in the direction of the arrows C in FIG. 6A) in order to bring the long sides of the oval together, for example, by bringing points A and B of one arcuate portion or another (indicated in FIG. 6A) in contact, such a movement is not actually possible.

In order to successfully bring the two opposite ends of the frame together, in fact, it would be necessary to allow the oval to expand in a longitudinal direction (in the direction of the arrow D), as an effect of the forces of elastic recoil. However, if the case body is designed in flexible and foldable but not extendable material, the extension of the frame in a longitudinal direction is not, in fact, allowed.

If instead the case body is designed of flexible, foldable and also extendable material, for example, a resilient fabric, the extension of the case in a longitudinal direction is nevertheless highly limited. The resilient fabric is actually able to extend resiliently to a moderate extent, so as not to comply with the expansion required for the frame, if not corresponding to a modest deformation. In addition, once subjected to stretching, the resilient fabric presents a tendency towards elastic recoil, with the sufficient elastic recoil force to return the frame to its original form as soon as the external stress is stopped.

The frame (and the case) is therefore not deformable or compressible or foldable, in the sense of bringing the two sides of the oval together. At the most, it is possible to bring the two middle points (points M1 and M2 in FIG. 6A) together.

Regarding the materials, the case body 2 can be made of fabric or natural or artificial leather or a plastic film or sheet.

From among these, it is possible to choose a resilient and therefore resiliently extendable fabric, or a non-resilient fabric, that is, a non-extendable fabric.

Similarly, in case the choice is for a plastic film or sheet, it is possible to choose a resiliently extendable plastic material or a non-extendable plastic material.

In particular, in case a resiliently extendable plastic material is used, it is possible to design the case body 2 so that it does not have a closing mechanism for opening 2*a*, configured, for example, as a slot or opening. By suitably dimensioning the two opposite ends of the opening 2*a*, such that they are even just slightly overlapping in the "resting" position, it is in fact possible to exploit the resilience of the material with which the case body is made and to obtain a sort of automatic closure. In order to insert the frame into the case through the opening, in which case it suffices in fact to lightly move one of the edges of the opening from the other, to a sufficient extent so as to allow the frame to pass between them. Once the frame is inserted into the case and the two edges of the opening have been released, these will return spontaneously to their original position, thereby closing the opening in the case, due to the tendency towards elastic recoil of the material from which they are made.

In an alternative version, it is possible to design only the portion of the case body corresponding to the concerned region of the slot or opening in resilient material and to design the rest of the case body in non-elastic material.

It should be noted that that designing a slot with an automatic closure of the type described above offers the advantage of avoiding the integration of components that could damage the frame in case of accidental contact or sliding. For example, a zipper mechanism typically consists of a series of solid elements often characterised by corners, which are sufficiently pronounced to superficially damage the frame or the lenses of the glasses due to potential unintentional rubbing. Such rubbing can occur during the operation of inserting or removing the frame from the case, or also through the simple movement of the frame within the case.

To hold the frame 4 within the case body 2, it is expected in one embodiment that the filiform element 5 be stitched together to the case body along the outer border 6. Such a solution is efficient, for example (but not only), if the case body is designed in fabric or leather.

Figure 14:
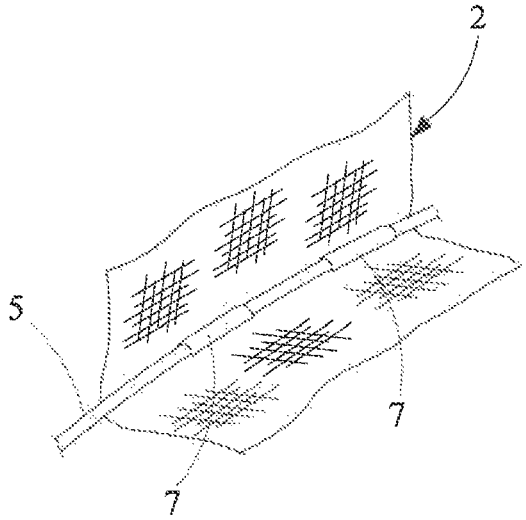
FIG. 14 is a partial magnified perspective view in sections of an element of the case from the preceding figures.
Figure 15:
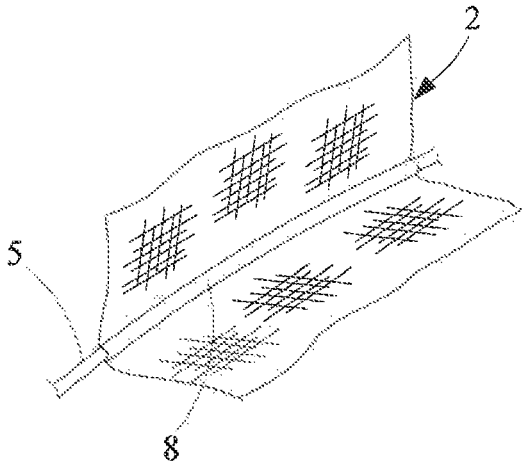
FIG. 15 is a view corresponding to that of FIG. 14 in a variant achieved of the element depicted.

An additional embodiment expects the case body to have outer edges 6 which are provided on the inside of said case body, with tubular rims 7 for receiving and holding the filiform element 5 of said frame (FIG. 14). Said tubular rims 7 are conveniently made of folded and sewn fabric and can extend continuously along the inner part of the outer border or can alternatively be designed as a variety of tubular formations, each of which presents reduced extension (along the corresponding outer border), such tubular formations being positioned along each outer border and mutually distanced with a predetermined distance value. Or, said tubular rims 7 comprise a flexible casing 8 that is stitched along the outer edges of the case body 2 (FIG. 15), between which the wire of the inner frame is threaded.

Figure 8:
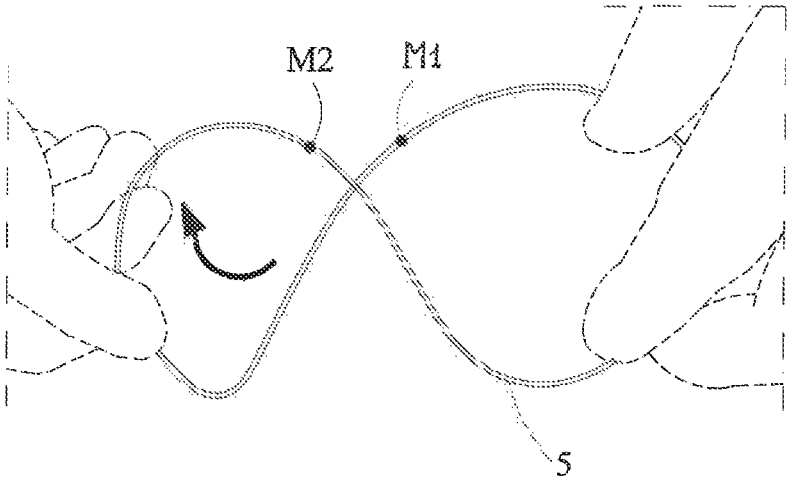

If the frame is subjected to a torsional movement, rotating portions 5*a*, 5*b* of the oval in such a way as to bring together and then superimpose the two central sections of the two opposing sides, as illustrated in FIG. 8, in order to obtain an "eight-shaped" configuration, the elastic resistance offered by the frame is low and the operation is easy.

In this case, in fact, to allow the operation, the body of the case must simply be folded, with no need to extend in any direction of the space.

The frame (and the case) are therefore deformable/foldable, in the sense of direct torsion into the "eight-shaped" conformation.

It should be noted how the two sections corresponding to the middle points of the two branches of the oval (points M1 and M2) are not superimposed in the "eight-shaped" configuration, but located at an equal distance. In practice, however, the frame lies on a single plane.

Even so, the "eight-shaped" configuration does not represent a stable form of the metallic frame, that is, it does not tend to remain firm and immutable.

In fact, there remains a configuration characterised by a certain value of elastic energy. If the strength or set of connections that keep it firm are lacking, the case folded into an "eight-shape" spontaneously and quickly returns to its original shape.

Figure 9:
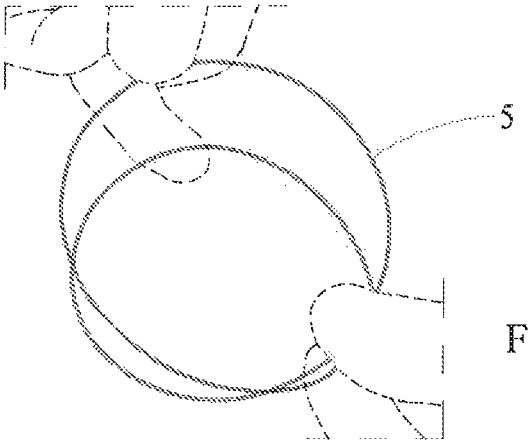
Figure 10:
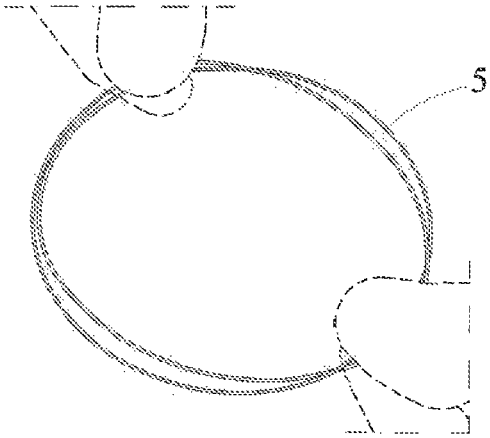

Starting with this configuration, with a further folding movement, the portions 5*a*, 5*b* are brought into a substantial mutual overlap until they reach a flattened configuration. In FIG. 9, the frame is illustrated while almost totally folded, while FIG. 10 illustrates the frame totally folded.

Even this flattened configuration, with a minimum size corresponding to that of the frame, does not represent a stable form of the frame, that is, it does not tend to remain firm and immutable. In fact, even this is a configuration characterised by a certain value of elastic energy. If the strength or set of connections that keep it firm are lacking (for example, a pocket, a bag, a rigid container), the folded case from FIG. 9 or 10 spontaneously and quickly returns to its original shape.

Since the material with which the case body is designed does not substantially oppose to the folding movements of the frame as described above, the case, starting with the extended configuration having its maximum size, can assume a second, non-operative configuration having a reduced size by means of a sequence of folding movements corresponding to those described above referring to the only filiform element of the frame.

Figure 11:
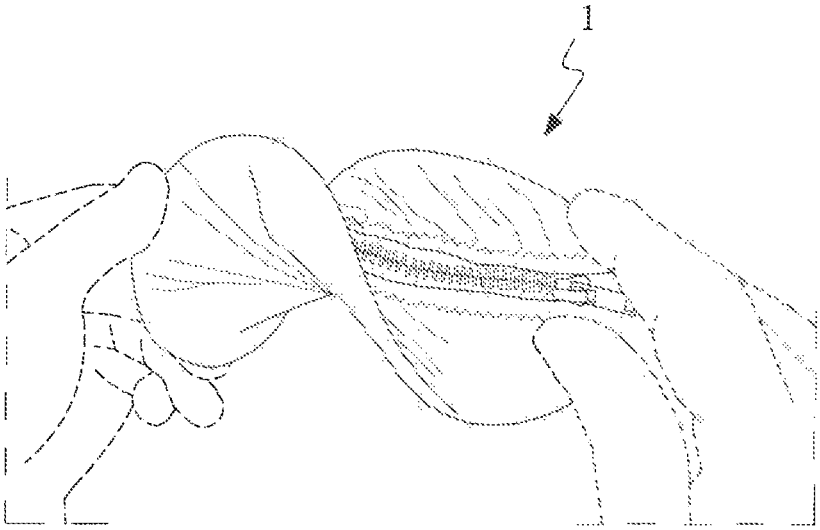
FIGS. 11, 12 and 13 are perspective views of the case in a sequence of folding phases corresponding to the sequence from FIGS. 8-10.
Figure 12:
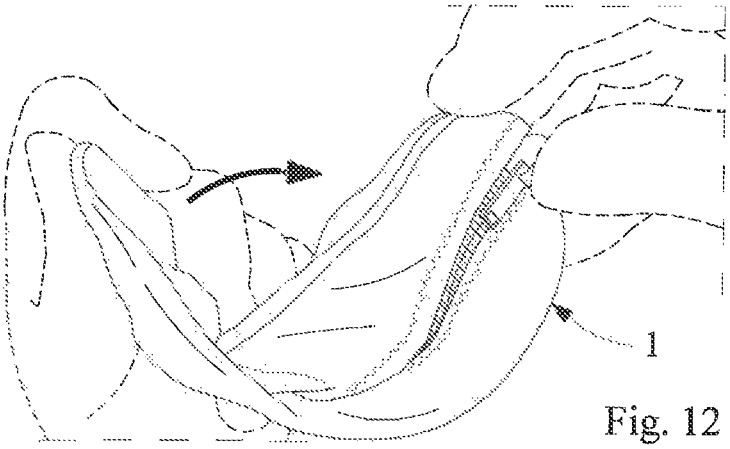
Figure 13:
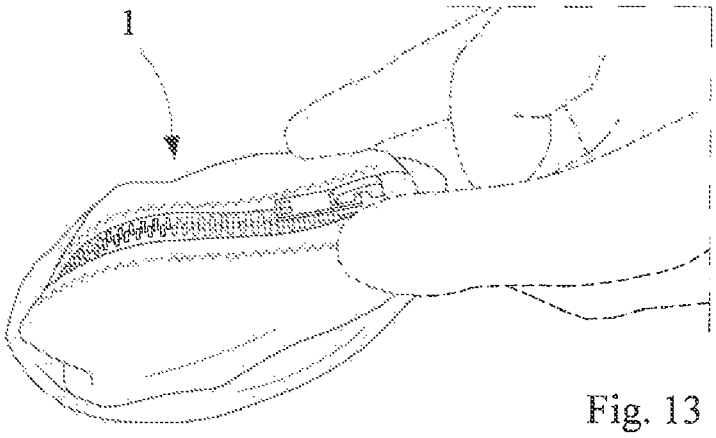

Folding of the case can only occur on condition that a first folding with relative tension between portions 5*a*, 5*b* of the frame starts being applied, in order to achieve an "eight-shaped" configuration, with which the case is nearly flattened on its plane, as illustrated in FIG. 11. This is followed by a second turned fold to bring the two drop-shaped profiles of the "eight" shape (corresponding to frame portions 5*a*, 5*b*) into a position of mutual overlap, to reach the flattened case conformation, illustrated in FIG. 13, in which the drop-shaped profiles are overlaid in mutual contact, obtaining the configuration having the minimum size, with which the case with extremely compact dimensions can be placed easily and comfortably in a pocket, for example.

If the case is removed from the pocket, or from any container that constrains it to the most reduced dimensions (therefore freed from any constraint), the case "reopens" automatically. If freed from potential constraints, in fact, the case spontaneously covers its original form ("saddle-shaped" configuration) in a few moments, through the effect of the elastic recoil action (generated by the elastic tension states accumulated in the frame folding phases), which manifests itself in the inner metallic frame.

If a resilient material, that is, a resiliently extendable material, is used for the case body, the case body's tendency towards a spontaneous elastic recoil can be added to the elastic recoil action that manifests itself in the inner metallic frame, therefore determining to some extent an increase in the "automatic reopening" effect of the case, in terms of the speed and briskness of the event. In one embodiment, it is expected that the case be able to be held in the operative configuration having a reduced size by means of one or more hooking or holding elements integrated into the case itself.

In particular, it is possible to provide a removable fixture system on the case, for example "snap buttons," in this case applying the "masculine" 9*a* and "feminine" 9*b* components of one or more press buttons 9 on the body of the case, on the upper surface and the lower surface respectively of the case itself, in symmetrical positions with respect to a plane of symmetry passing through the upper area 5*c* of the saddle and perpendicular to the original plane on which the ring lies, which is made up of the inner frame, such positions being preferably located in the proximity of each of the two opposite arcuate portions 5*a*, 5*b*. In such a position, once the case is folded into the operative configuration having a reduced size, the "masculine" and "feminine" components, respectively, of the press button or buttons appear to be mutually placed in the right direction, and can thus perform their function as a removable fixture.

Figure 17:
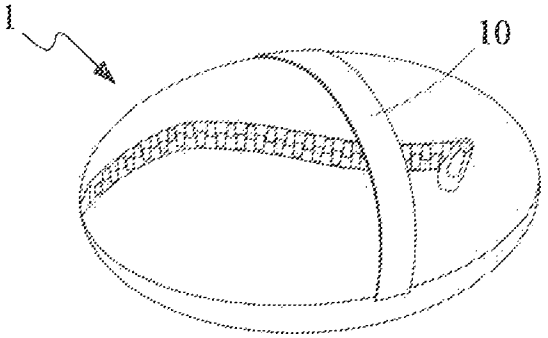
FIG. 17 is a schematic view corresponding to that of FIG. 13 with a second example of the case's holding system illustrated in the reduced-space configuration.
Figure 16:
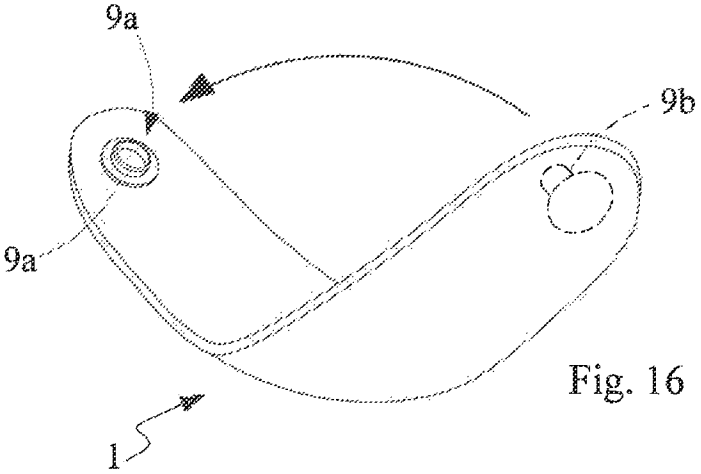
FIG. 16 is a schematic view corresponding to that of FIG. 12 with a first example of the case's holding system illustrated in the reduced-space configuration.

Otherwise, it is possible to integrate a strip 10, resilient or also non-resilient, made of the same material used for the case body, or also with a different material provided that it still be discretely soft and foldable or flexible, such strips being fixed (for example, sewn) with both their ends on a prefixed area of the outer edge of the case, so as to obtain a buttonhole with dimensions corresponding to the dimensions of the case folded into the position having a reduced size (FIG. 17). It is thus possible to insert the folded case into the opening lying under the strip, to then use the strip as a means of temporarily connecting the case in the folded configuration, independent of the use or without other possible binding means such as a bag, a pocket, etc.

Figure 18:
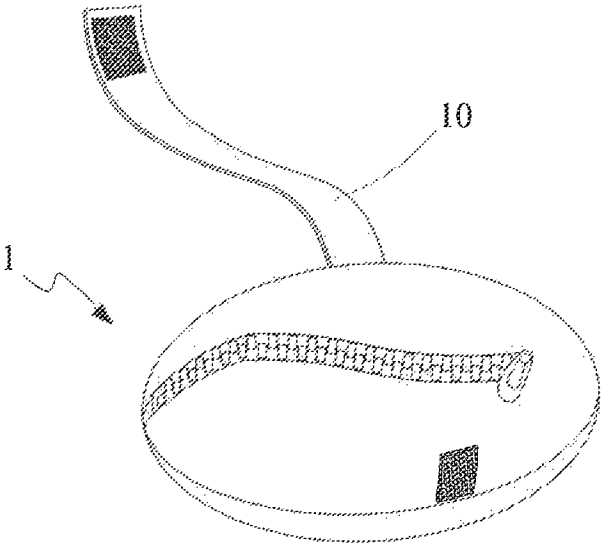
FIG. 18 is a view corresponding to that of FIG. 17 relative to a variant of the second example of the case's holding system in the reduced-space configuration.

As an alternative, the strip can be partially made and supplied with respect to the case, for example, being configured into an oval or ring shape (therefore with the two ends fixed to one another so as to obtain a closed profile), or in the form of a strip with an open profile and provided with a removable fixture system, for example, of a "Velcro" type, for the mutual fixture of the two ends (FIG. 18).

The invention thereby fulfils the proposed purposes achieving the stated advantages regarding all solutions cited.

A primary advantage is that the case according to the invention can be comfortably folded (when not in use), to go from a volume with an elevated capacity (also suitable to contain glasses having a significant size and dimensions) to an extremely reduced size, which allows it to be stored, for example, in the pocket of a piece of clothing.

The invention claimed is:

1. A glasses case having a reducible size and configured to house a glass frame, comprising:

an inner frame (4) including a filiform element (5) made of resiliently flexible material, said filiform element has a closed profile and is folded so as to assume a first, substantially saddle-shaped, operative configuration, in which two portions (5*a*, 5*b*) of said element are formed that extend laterally from opposite sides with respect to a top zone (5*c*) of the element, and a case body (2) that is provided to hold the inner frame (4) in said operative configuration, said body (2) being made of a thin flexible material, and is connected to the inner frame (4) along its profile and extends so as to delimit a closeable inner volume of the glasses case, wherein the case body (2) comprises an opening (2*a*) and a closure element (2*b*) to close the opening (2*a*) thereby closing the inner volume of the case body (2), said glasses case can assume a second, non-operative configuration having a smaller size by means of a first relative torsional fold of the frame portions (5*a*, 5*b*), thus forming a substantially eight-shaped configuration, followed by a second fold, which allows said frame portions to be brought together such that they lie one on top of the other until a substantially flattened shape of the glasses case is obtained.

2. The glasses case according to claim 1, wherein said inner frame (4) is a wire made of metal or plastic material.

3. The glasses case according to claim 1, wherein said filiform element (5) has opposing free ends that are connected to one another by a first deformation so as to form a ring having a closed profile, said saddle shape being achieved by a second deformation of said ring on the plane on which the ring lies such that the ring assumes an oval shape, followed by a third deformation, by which the oval is folded in an arcuate shape in a plane that is perpendicular to the plane on which the ring lies and in a direction that is transverse to the direction in which the second deformation takes place.

4. The glasses case according to claim 1, wherein said case body (2) is made of fabric or natural or artificial leather or a plastic film or sheet.

5. The glasses case according to claim 1, wherein the filiform element (5) is held on the case body (2) by stitching provided to connect the filiform element (5) along the outer edges (6) of the glasses case.

6. The glasses case according to claim 1, wherein said case body (2) has outer edges (6) which are provided on the inside of said case body, with tubular rims (7) for receiving and holding the filiform element (5) of said inner frame.

7. The glasses case according to claim 6, wherein said tubular rims (7) are made of fabric that is folded and stitched.

8. The glasses case according to claim 6, wherein said tubular rims (7) comprise a flexible casing (8) that is stitched along the outer edges (6) of the case body (2).

9. The glasses case according to claim 1, wherein said filiform element (5) is made of spring steel.

10. The glasses case according to claim 1, wherein the glasses case spontaneously returns to the first configuration from the second configuration, thereby returning the inner frame (4) its saddle-shaped form, as a result of a resilient tensional state accumulated during the folding steps to form the second configuration having a smaller size.

* * * * *